US006860768B2

(12) United States Patent
Zhao

(10) Patent No.: US 6,860,768 B2
(45) Date of Patent: Mar. 1, 2005

(54) COMBINATION SLEEVE AND SPRING CAGE INCORPORATED INTO A ONE-PIECE FEMALE TERMINAL FOR INTERENGAGING A CORRESPONDING MALE TERMINAL AND METHOD OF CONFIGURING SUCH A SLEEVE AND SPRING CAGE FROM A BLANK SHAPE

(75) Inventor: Weiping Zhao, Allen Park, MI (US)

(73) Assignee: Alcoa Fujikura Limited, Franklin, TN (US)

( * ) Notice: Subject to any disclaimer, the term of this patent is extended or adjusted under 35 U.S.C. 154(b) by 28 days.

(21) Appl. No.: 10/428,528

(22) Filed: May 1, 2003

(65) Prior Publication Data

US 2004/0014370 A1 Jan. 22, 2004

Related U.S. Application Data

(63) Continuation-in-part of application No. 10/079,206, filed on Feb. 21, 2002, now Pat. No. 6,672,911, which is a continuation-in-part of application No. 09/951,012, filed on Sep. 14, 2001.

(60) Provisional application No. 60/271,776, filed on Feb. 27, 2001, and provisional application No. 60/232,698, filed on Sep. 15, 2000.

(51) Int. Cl.[7] ..... H01R 11/22

(52) U.S. Cl. ..... 439/852; 439/843

(58) Field of Search ..... 439/843–847, 439/852, 853, 851

(56) References Cited

U.S. PATENT DOCUMENTS

| | | | | | |
|---|---|---|---|---|---|
| 3,557,428 | A | * | 1/1971 | Bonhomme | 29/747 |
| 4,657,335 | A | | 4/1987 | Koch et al. | 339/256 |
| 4,734,063 | A | | 3/1988 | Koch et al. | 439/844 |
| 5,645,458 | A | * | 7/1997 | Hotea | 439/852 |
| 5,658,175 | A | * | 8/1997 | Muzslay | 439/852 |
| 5,921,822 | A | * | 7/1999 | Kennedy et al. | 439/851 |
| 6,152,787 | A | * | 11/2000 | Serbin et al. | 439/852 |
| 6,254,439 | B1 | * | 7/2001 | Endo et al. | 439/843 |
| 6,264,509 | B1 | * | 7/2001 | Kwang et al. | 439/852 |
| 6,358,104 | B2 | * | 3/2002 | Daugherty et al. | 439/851 |
| 6,425,786 | B1 | * | 7/2002 | Scholler | 439/843 |
| 6,520,998 | B1 | * | 2/2003 | Scholler et al. | 439/851 |
| 6,656,002 | B2 | * | 12/2003 | Zhao et al. | 439/851 |

* cited by examiner

*Primary Examiner*—Gary Paumen
(74) *Attorney, Agent, or Firm*—Tracey D. Beiriger

(57) ABSTRACT

A one piece blank including a configurable and combination sleeve and spring cage, defining a first female connector, and which is interengageable with a male connector having an extending male terminal pin insertable within an opposing open end of the female connector, such that both a greater area of electrical contact and increased normal holding forces are established therebetween. The female terminal further includes a plurality of interiorly extending and elongated beams, accessible through said open end, and which are configured in a combined angled and torsional manner in order to achieve a three dimensional and substantially hourglass shaped configuration.

16 Claims, 11 Drawing Sheets

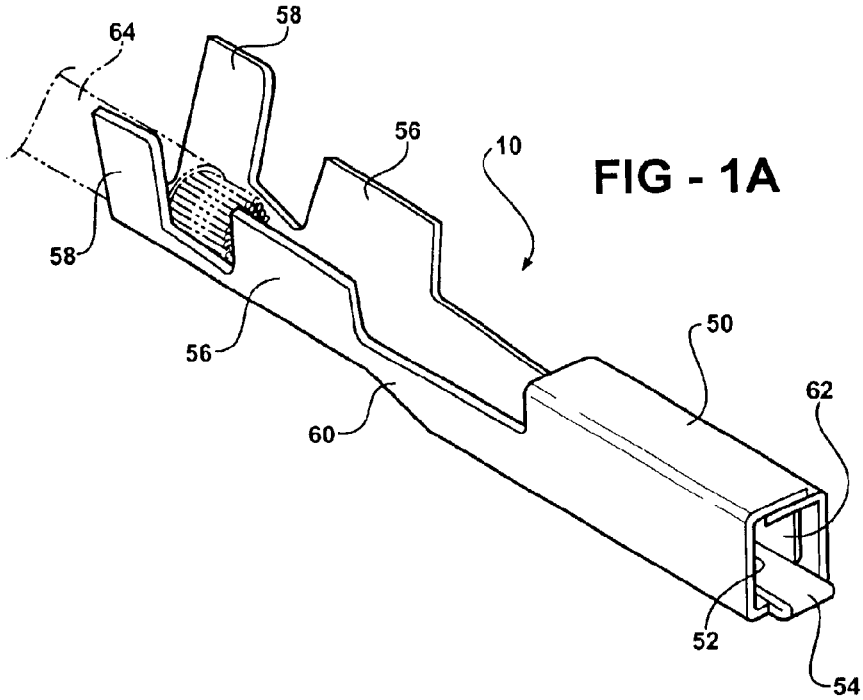
FIG - 1A
FIG - 2A
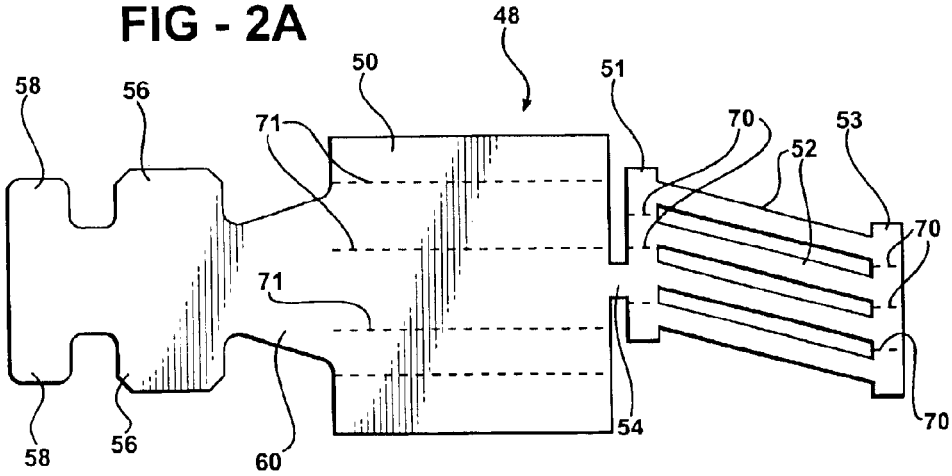
FIG - 2B
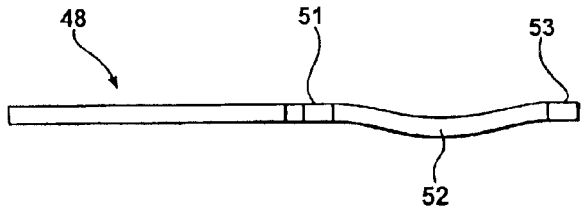

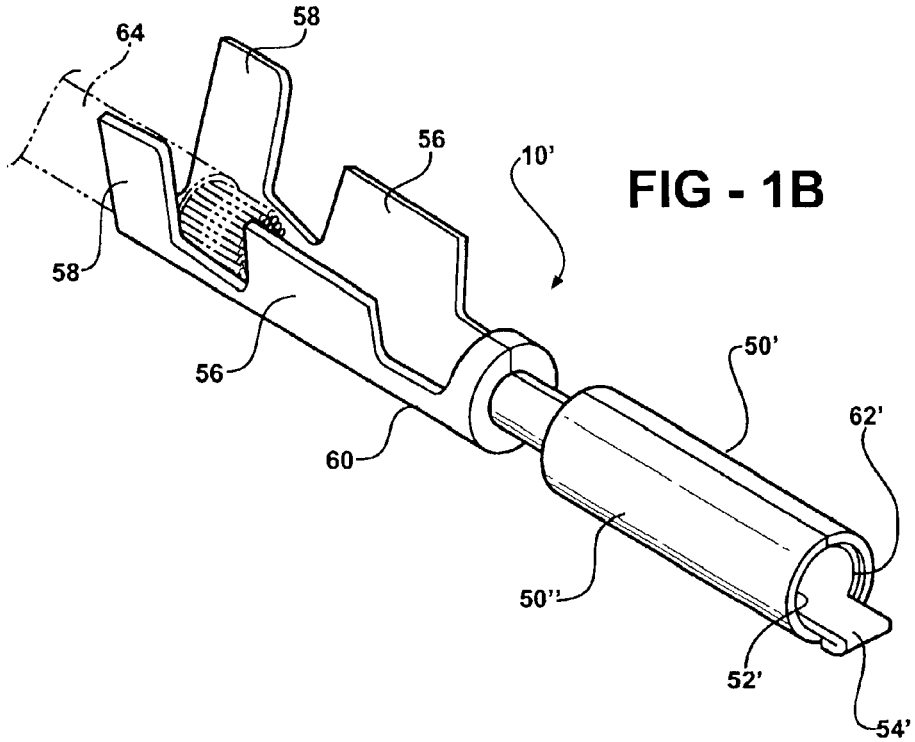
FIG - 1B
FIG - 2E
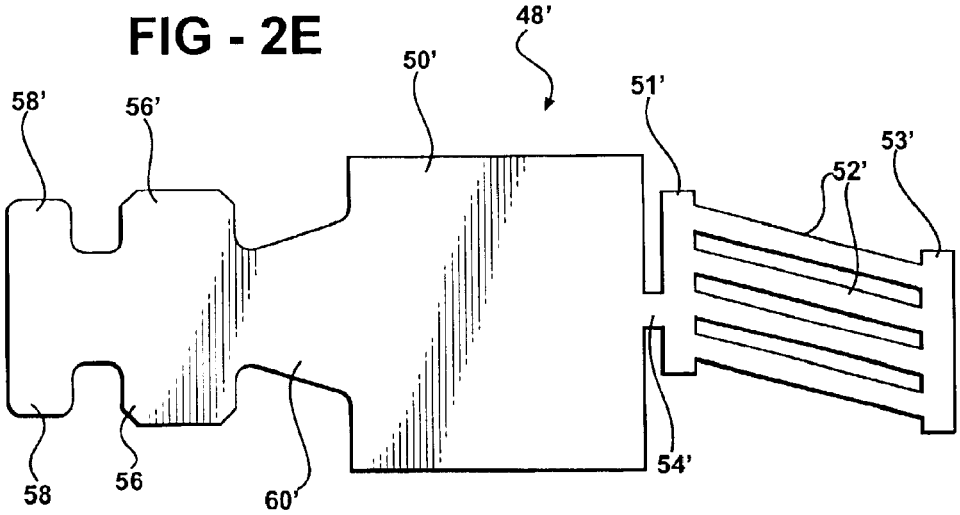
FIG - 2F
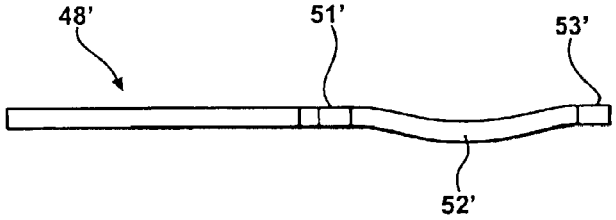

COMBINATION SLEEVE AND SPRING CAGE INCORPORATED INTO A ONE-PIECE FEMALE TERMINAL FOR INTERENGAGING A CORRESPONDING MALE TERMINAL AND METHOD OF CONFIGURING SUCH A SLEEVE AND SPRING CAGE FROM A BLANK SHAPE

CROSS REFERENCE TO RELATED APPLICATIONS

The present application is a continuation in part application of U.S. application Ser. No. 10/079,206, filed Feb. 21, 2002 now U.S. Pat. No. 6,672,911 issued Jan 6, 2004, and entitled "Electrical Terminal Socket Assembly Including 90° Angled and Sealed Connectors", which is a U.S. application Ser. No. 09/951,012, filed Sep. 14, 2001, and also entitled "Electrical Terminal Socket Assembly Including Both T-Shaped and 90° Angled and Sealed Connectors"; which claims benefit of U.S. Provisional Application 60/271,776, filed Feb. 27, 2001, entitled "Power Feed Attachment"; and U.S. Provisional Application 60/232,698, filed Sep. 15, 2000, entitled "Power Feed Attachment".

FIELD OF THE INVENTION

The present invention relates generally to interengageable male to female terminals, such as are typically incorporated into sealed connector assemblies. More particularly, the present invention discloses a blank configurable and combination sleeve and spring cage for small terminal systems, defining a first female terminal, and which is interengageable with a male terminal having an extending male terminal portion, which is insertable within an opposing open end of the female terminal and such that both a greater area of electrical contact and increased normal holding forces are established therebetween. The present invention further discloses a method for configuring a metal and suitably electrically conductive blank into a female terminal.

BACKGROUND OF THE INVENTION

Electrical terminal sockets are well known in the art, one primary application of which being in the automotive field for establishing connections between an output cable and related components. The frictional grip imparted by the terminal must be of sufficient strength to maintain firm mechanical and adequate electrical connection, yet must permit relatively easy manual withdrawal or insertion of a prong into the socket.

According to application Ser. No. 10/079,206, filed Feb. 21, 2002 and U.S. application Ser. No. 09/951,012, filed Sep. 14, 2001, they provide a line contact between male and female terminals because of the manner in which the angled and hourglass contact beams are constructed. These applications demonstrated many significant advantages for these angled and hourglass beams.

The U.S. Ser. No. 10/079,206 application discloses a two piece design and in which the spring cage usually exhibits a thickness in the range of 0.3 mm to 0.6 mm, and a sleeve thickness in the range of 1.0 mm to 1.8 mm. Pin size ranges from 6.0 mm to 14.0 mm for high current applications. Due to differences in thickness, it has been found that the two piece design is unavoidable for high current applications. For medium and low current round pin terminals, however, the sleeve thickness can be reduce to the same thickness as its spring cage, therefore a one piece design is possible, especially for terminal sizes ranging from 0.40 mm to 4.30 mm diameters.

Additionally, these size terminals typically have a conventional round pin design, usually in two or more pieces, and which increases the manufacturing complexity and number of components. Therefore, the cost is high and also the point of contact from each spring beam between male and female reduces the current carry capability of the terminal.

SUMMARY OF THE INVENTION

The present invention discloses a female terminal for use with an interengaging male terminal and in order to create a secure and multiple contact connection therebetween. Each of the female and interengageable male terminals include an elongated body, a selected end of each terminating in bendable crimping portions for engaging associated ends of electrically conducting wire or cable. The elongated male terminal further includes an extending pin at a further associated end.

The female terminal is, in a preferred embodiment, originally provided as a substantially flattened and planar shaped blank, constructed of a metallic and electrically conductive material, and including a planar shaped main body, a plurality of elongated and spaced apart beams extending angularly from a stem portion interconnecting a first end of the main body, and wire crimping portions extending from a second end of the main body. An associated method of producing a female terminal forms a part of the present invention and includes the steps of folding the angled, elongated and spaced apart beams inwardly and over the planar shaped main body, bending the main body into a three dimensional and elongated configuration (either rectangular or circular, and not fully closed) and bending in inward and opposing fashion the wire crimping portions. Finally, the main body is formed into the desired shape, this further being either rectangular or circular.

In the preferred embodiment, the elongated beams are accessible through an open inserting end of the configured main body of the female terminal and are defined in a substantially three dimensional and helix (or hourglass) shape for engaging the inserting male pin along increased surface area and with a greater degree of normal holding forces. An insert tool assists in forming the desired array of the contact beams, such a tool including a shank end and a square shaped end (for a square terminal) or a round shaped end (for a round terminal) for engaging the open inserting end of the female terminal. The two insert tools, such as upon being engaged with interior facing surfaces of the angled beams, are served as mandrels to hold both ends and to avoid metal walking out along beams in a longitudinal direction during forming of the beams into an hourglass shape, and so as to impart a combined angular and torsional configuration to the angled beams and in order to increase both the contact area established with the male terminal pin as well as again increasing the normal holding forces between the male and female terminals.

BRIEF DESCRIPTION OF THE DRAWINGS

Reference will now be made to the attached drawings, when read in combination with the following detailed description, wherein like reference numerals refer to like parts throughout the several views, and in which:

FIG. 1A is a perspective view of a square female terminal constructed according to a first preferred embodiment of the present invention;

FIG. 1B is a further perspective view of a round female terminal constructed according to a further preferred embodiment of the present invention;

FIG. 2A is a plan view of a metal blank which is configurable into the square female terminal of FIG. 1A and according to the present invention;

FIG. 2B is a side view illustration of the blank illustrated in FIG. 2A and showing its pre-configured and arcuate side profile;

FIG. 2E is a plan view, similar to that shown in FIG. 2A, and illustrating a metal blank configurable into the round female terminal of FIG. 1B;

FIG. 2F a side view illustration of the blank illustrated in FIG. 2E and showing its pre-configured and arcuate side profile;

DETAILED DESCRIPTION OF PREFERRED EMBODIMENTS

Referring now to FIG. 1A, a perspective illustration is shown at 10 of a rectangular female terminal constructed according to a first preferred embodiment of the present invention. As explained previously, the present invention discloses a blank configurable and combination sleeve and spring cage.

The construction of the female terminal is further such that both a greater area of electrical contact and increased normal holding forces are established with an associated and inserting pin of the male terminal. As will be also subsequently described, the present invention further discloses a method for configuring a metal and suitably electrically conductive blank into a female terminal.

Figure 7:
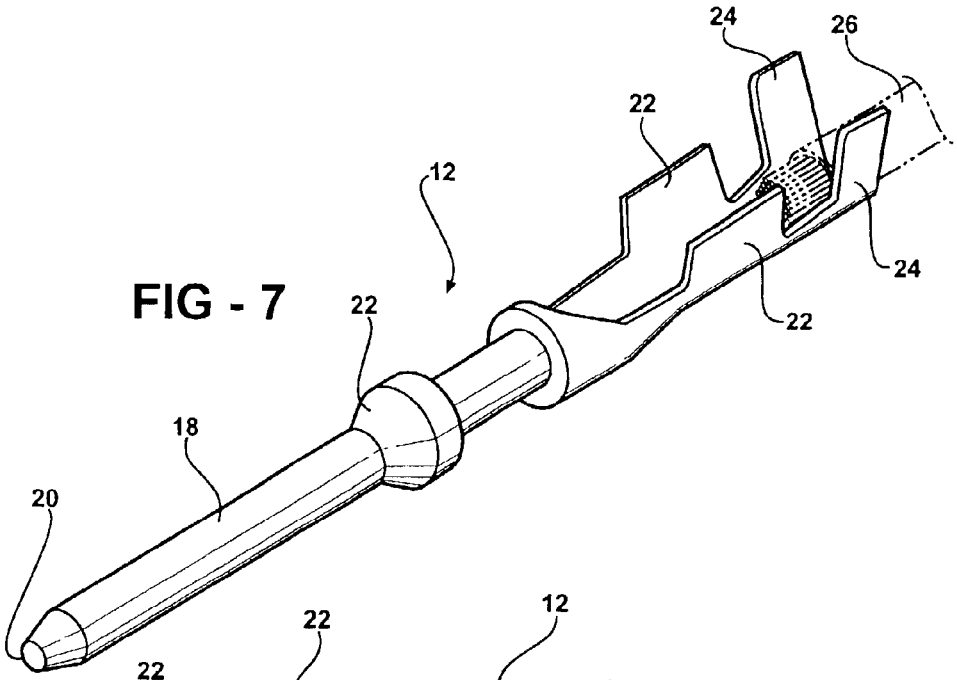
FIG. 7 is a perspective illustration of an interengaging male terminal according to the present invention.
Figure 8:
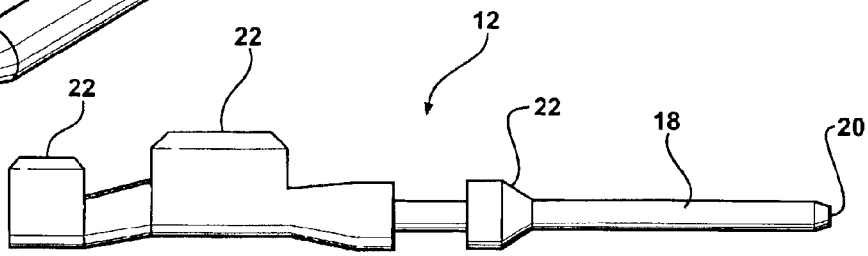
FIG. 8 is a plan view of the male terminal as substantially illustrated in FIG. 7.

Prior to engaging into a detailed description of the female terminal 10 and is associated method of manufacture, a brief description will be made of the associated and interengaging male terminal according to the present invention. The male terminal can be constructed in a number of varying configurations and reference is made to a first variant 12 of the male terminal in FIGS. 7 and 8 and a second variant 14 as shown in the perspective view of FIG. 9 and succeeding front end view of FIG. 11.

While it is contemplated that a given male terminal can be constructed in particular fashion for use with the female terminal according to the present invention, such male terminals, with inserting pins, are generally known in the art. That said, the variant 12 of male terminal (again FIGS. 7 and 8) exhibits an elongated and round cross sectional body largely consisting of a pin 18 with a pointed end 20 and an enlarged annular intermediate location 22. Wire crimping portions 22 and 24 extend from a further associated end of the male terminal and, upon being bent in inwardly opposing fashion, forcibly engage over an extending end of a wire or cable, see as illustrated at 26 in FIG. 7.

Figure 9:
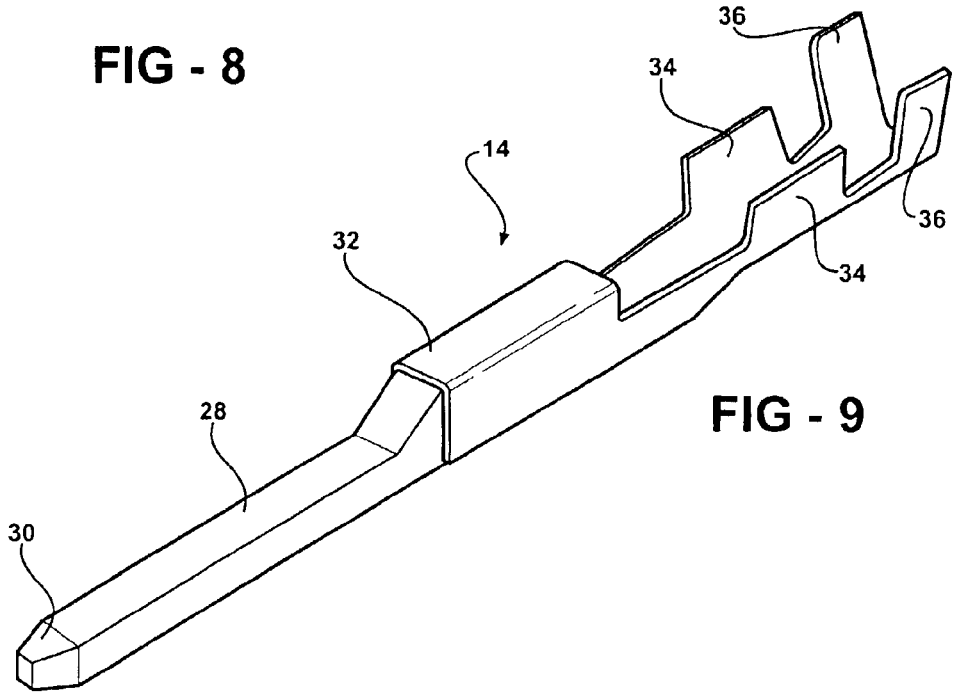
FIG. 9 is perspective view of a male terminal exhibiting a square shaped inserting pin.
Figure 11:
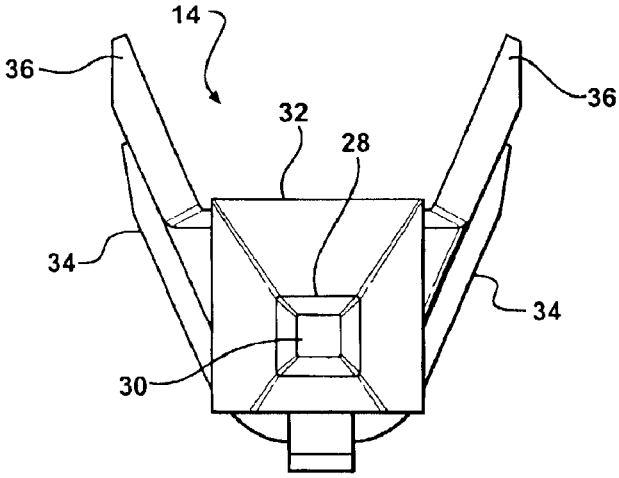
FIG. 11 is an end view of the male terminal illustrated in FIG. 9.

The succeeding variant 14 of male terminal, shown again in FIGS. 9 and 11, exhibits a substantially rectangular (square) cross sectional body again largely consisting of a pin 28 with a pointed end 30 and an enlarged annular intermediate location 32. Wire crimping portions 34 and 36 again extend from a further associated end of the male terminal and, upon being bent in inwardly opposing fashion, forcibly engage over an extending end of a wire or cable, not shown in these illustrations but substantially as seen as illustrated at 26 in the alternate variant of FIG. 7. The male terminal pin portions, according to any of the previously disclosed embodiments, can range in cross sectional dimension to include such at 4.3 mm, 2.8 mm, 1.6 mm, 1.0 mm, 0.64 mm and 0.45 mm pin diameters among such possible sizes.

Having provided an adequate explanation of the features of the male terminals according to the several variants disclosed herein, reference is again made to the female terminal 10 according to the first disclosed embodiment of the present invention. At this point, it would also be convenient to provide an explanation of the associated method employed according to a preferred embodiment and for producing the female terminal 10.

Referring to the plan view of FIG. 2A, a metal blank 48 is indicated and which is configurable into the female terminal 10 of FIG. 1A. In particular, the metal blank 48 is constructed of an electrically conductive material, such as a copper alloy, and includes a planar shaped main body 50, a plurality of angled, elongated and spaced apart beams 52 (see also carrier tab portions 51 and 53 and which in a preferred embodiment separate and support at opposite ends a plurality of at least three extending beams, here showing four beams by example) extending from a stem portion 54 interconnecting a first end of said main body 50, and wire crimping portions 56 and 58 extending from a second end of said main body 50 and interconnected by a further portion 60.

Figure 2C:
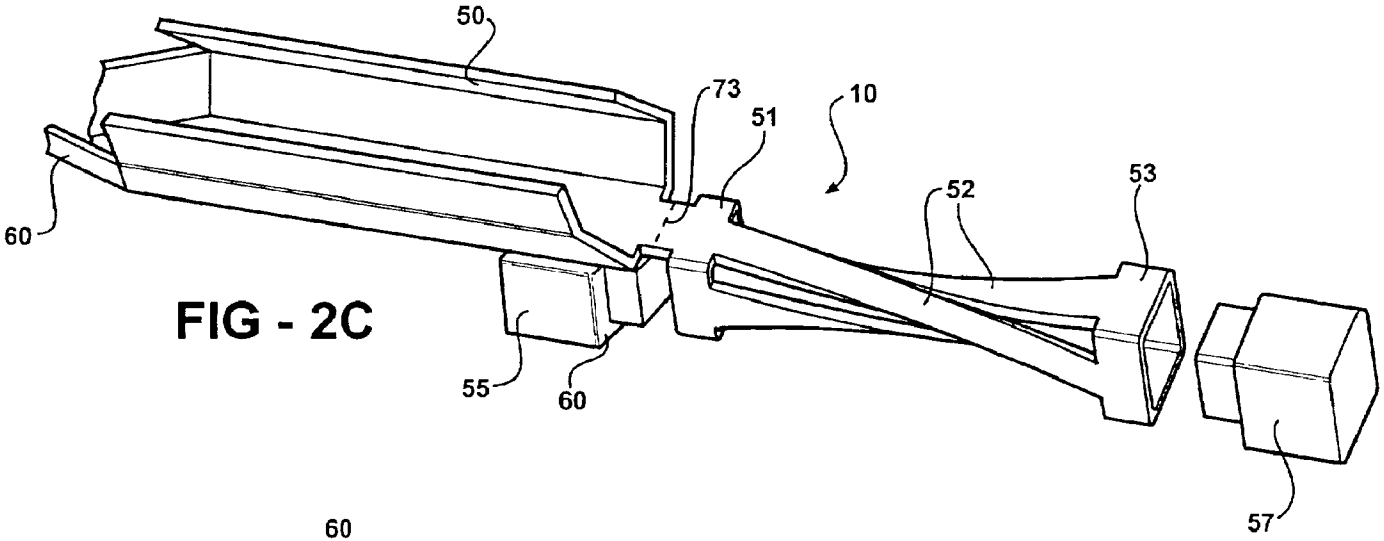
FIG. 2C is an illustration of an intermediate assembly condition of the metal blank of FIG. 1A.
Figure 2D:
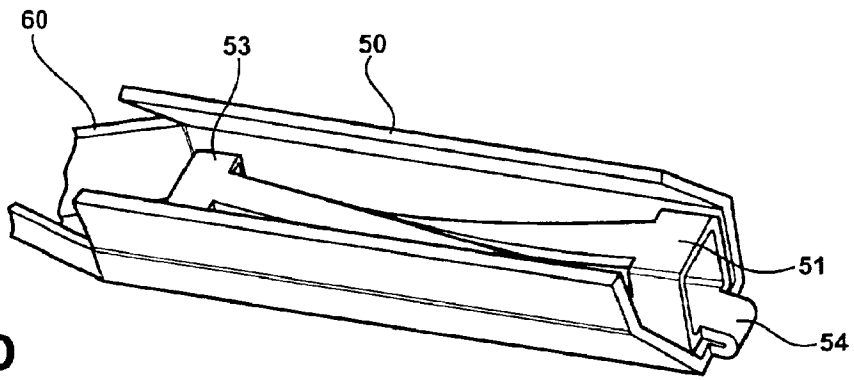
FIG. 2D is partial elevational view of the blank also shown in FIG. 2C and illustrating a still further and substantially completed assembly step of the square female terminal.

A side view illustration of the blank 48, illustrated in FIG. 2B, shows its pre-configured and arcuate side profile of the beams 52. Referring also to FIGS. 2C and 2D, the progressive method steps for forming the three dimensional female terminal (see again by example at 10 in FIG. 1A) are shown. As shown in FIG. 2C, the carrier tab portions 51 and 53 and spaced apart beams 52 are configured in the three dimensional and square shaped manner illustrated. The torsioning and angling of the beams 52, after the carrier tab portions 51 and 53 are initially bent into their three dimensional cross section, is further accomplished by inserting mandrels 55 and 57, exhibiting square shaped inserting portions, into tab portions 51 and 53. In the preferred variant, a series of forming tools (not shown) bend the tab portions 51 and 53 in the manner shown in FIG. 2A along bending lines 70, in a certain forming sequence (the forming tools not being shown but understood to exist), until achieving a final square shape 51 and 53 in FIG. 2C. The preconfigured and arcuate side profile of the beams 52 are further constructed into an hourglass shape after the series of forming stations. In the preferred variant, the mandrels 55 and 57 (again FIG. 2C) exit at every forming station, the purpose for which being to hold the two ends of the female terminal to avoid metal walking out along a longitudinal direction during forming of the beams into an hourglass shape, effectuating the combined angling and torsioning of the beams 52.

Referring again to FIG. 2B, a succeeding assembly step is illustrated and in which the planar shaped main body 50 is bent along a bending line 71 (see again FIG. 2A) in a pre-opening fashion 50 in FIG. 2C. Referring further to FIG. 2D, a succeeding assembly step is illustrated and in which the angled, elongated and spaced apart beams 52 are folded inwardly along a bending line 73 (again FIG. 2C) and seated inside the main body 50, the body 50 then being folded around the beams 52 in a likewise square shaped fashion and in order to define an open inserting end (generally shown at 62 in FIG. 1A) and within which is encased the angled, elongated and spaced apart beams 52. Completing the initial assembly operation is the step of bending in inward and opposing fashion the wire crimping portions 56 and 58, as well as the intermediate and interconnecting portion 60 separating the wire crimping portions with the rectangularly configured main body 50. As is also shown in FIG. 1A, a further wire or cable (see at 64 in phantom) is grippingly engaged by the inwardly folding of the crimping portions 56 and 58 and in order to electrically communicate the female terminal 10 in the same fashion as the cable 26 described in FIG. 8 likewise electrically communicates the associated male terminal 12.

Referring to the plan view of FIG. 2E, a metal blank 48' is indicated, which is a variant of the blank 10 forming the square shaped terminal 10 in FIG. 1A, and which is configurable into a round cross sectional female terminal 10' as shown in FIG. 1B. In particular, the metal blank 48' is again constructed of an electrically conductive material, such as a copper alloy, and includes a planar shaped main body 50', a plurality of angled, elongated and spaced apart beams 52' (see also carrier tab portions 51' and 53' and which in a preferred embodiment separate and support at opposite ends a plurality of at least three extending beams, here again showing four beams by example) extending from a stem portion 54' interconnecting a first end of the main body 50', and wire crimping portions 56' and 58' extending from a second end of said main body 50' and interconnected by a further portion 60'.

Figure 2G:
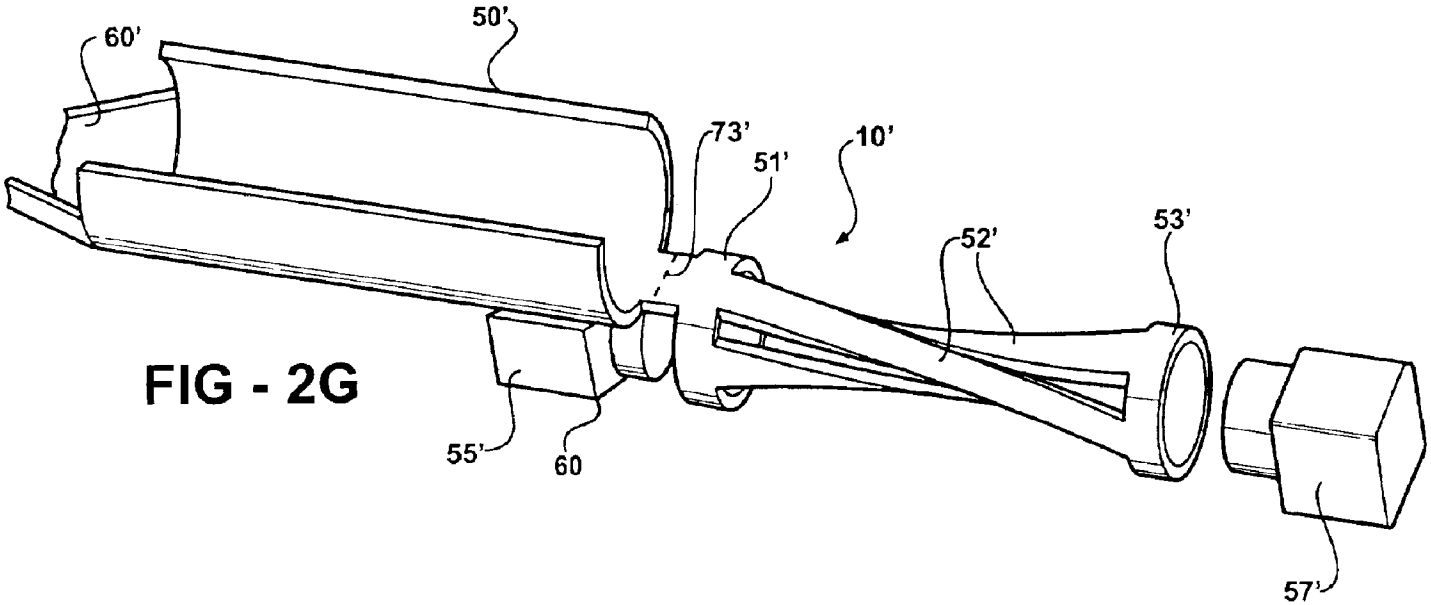
FIG. 2G is an illustration of an intermediate assembly condition of the metal blank of FIG. 1B.
Figure 2H:
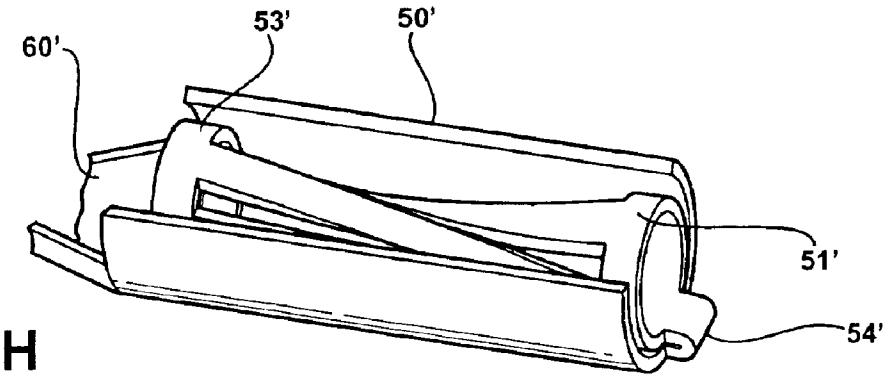
FIG. 2H is partial elevational view of the blank also shown in FIG. 2G and illustrating a still further and substantially completed assembly step of the round female terminal.

A side view illustration of the blank 48', illustrated in FIG. 2F and similar to that illustrated in the previously disclosed variant of FIG. 2B, shows its pre-configured and arcuate side profile of the beams 52'. Referring also to FIGS. 2G and 2H, the progressive method steps for forming the three dimensional round female terminal (see again by example at 10' in FIG. 1B) are shown. As shown in FIG. 2G, the carrier tab portions 51' and 53' and spaced apart beams 52' are configured in the three dimensional and round shaped manner illustrated. The torsioning and angling of the beams 52', after the carrier tab portions 51' and 53' are initially bent into their three dimensional and round cross section, is further accomplished by inserting mandrels 55' and 57', exhibiting round shaped inserting portions, into tab portions 51' and 53'.

In the preferred variant, a series of forming tools (not shown) bend the tab portion 51' and 53' in FIG. 2E in a certain forming sequence (the forming tools again not being shown but exist as known in the art), until achieving the final round shape 51' and 53', see further FIG. 2G. The preconfigured and arcuate side profile of the beams 52' are further constructed into an hourglass shape after the series of forming stations.

In another preferred variant, the mandrels 55' and 57' (corresponding to mandrel 57 in the previously disclosed embodiment) exist at every forming station, the purpose for which is to hold the two ends and to avoid metal walking out along a longitudinal direction during forming the beams into an hourglass shape, further effectuating the combined angling and torsioning of the beams 52'.

Referring further to FIG. 2F again, a succeeding assembly step is illustrated and in which the planar shaped main body 50' is formed in a pre-opening fashion 50' (FIG. 2G). Referring further to FIG. 2H, a succeeding assembly step is illustrated and in which the angled, elongated and spaced apart beams 52' are folded inwardly along a bending line 73' and seated inside the main body 50', the body 50' then being folded around the beams 52' in a likewise round shaped fashion and in order to define an open inserting end (generally shown at 62' in FIG. 1B) and within which is encased the angled, elongated and spaced apart beams 52'.

In the fashion explained above, and again referring to FIG. 6A in the initial preferred embodiment, the rectangularly folded portions of the main body 50 of the female terminal main body, which encircle the beams 52, cause in combination with the mandrels 55 and 57 the combined angling and torsioning of the beams 52 into a substantially helix or hourglass shape (see as generally represented at 72 in FIG. 6A). As further represented in each of the cutaway illustrations of FIGS. 3A and 4A, the combined angling and torsional relationship of the elongated beams 52 is again illustrated in three dimension and to thereby facilitate both increased contact area (see FIGS. 3A and 4A where beams 52 are wrapped along a male pin and therefore have lines of contact instead of points of contact) and normal holding forces established with the inserting pin end of the corresponding and interengaging male terminal.

Figure 4A:
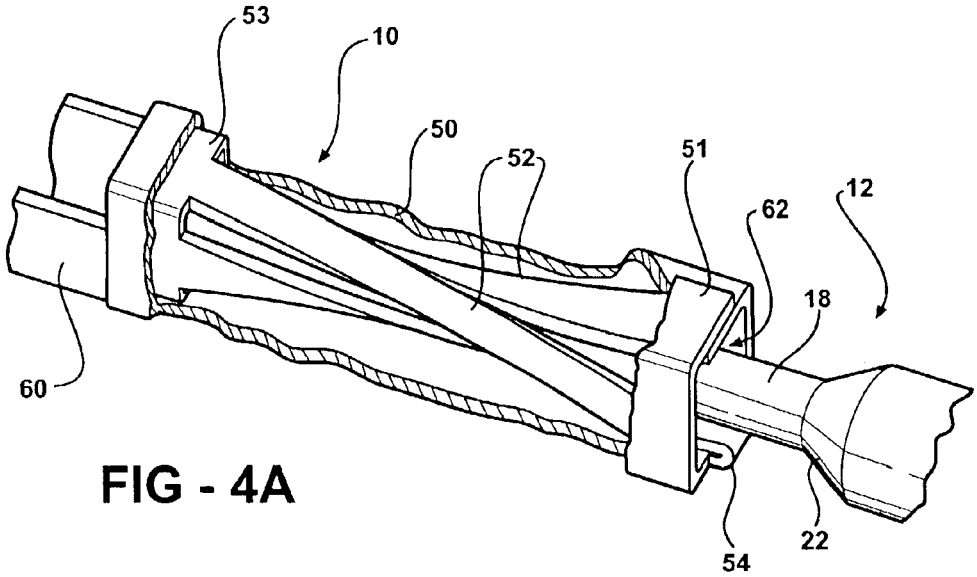
FIG. 4A is a further cutaway illustration of the square female terminal illustrated in FIG. 1A and further showing the combined torsioned and angled contact beams in interengaging fashion with a round cross sectional male inserting pin.
Figure 4B:
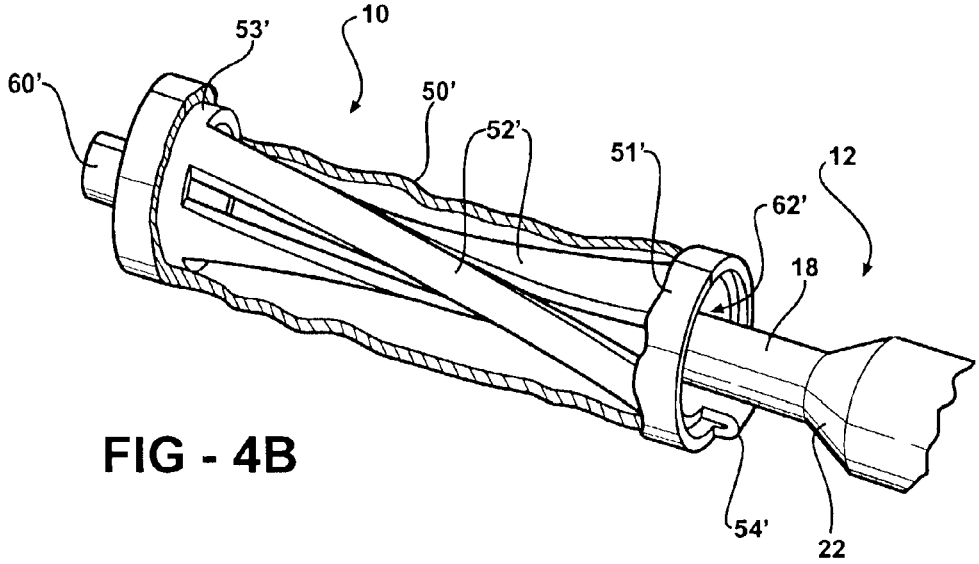
FIG. 4B is a further cutaway illustration of the round female terminal shown in FIG. 1B, and further showing the combined torsional and angled contact beams in interengaging fashion with a round cross sectional male inserting pin.
Figure 5A:
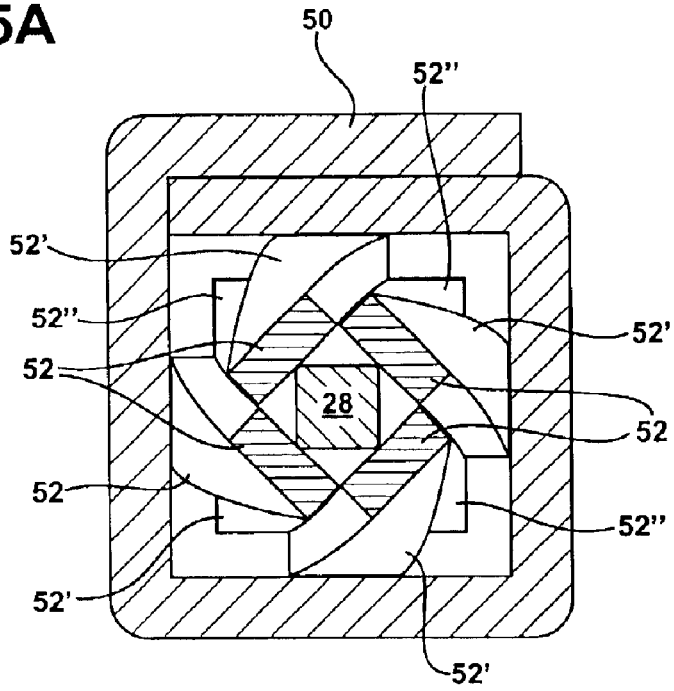
FIG. 5A is an open end view of the female terminal illustrated in FIG. 3A and showing the manner in which the male square pin interengages the female terminal.
Figure 10A:
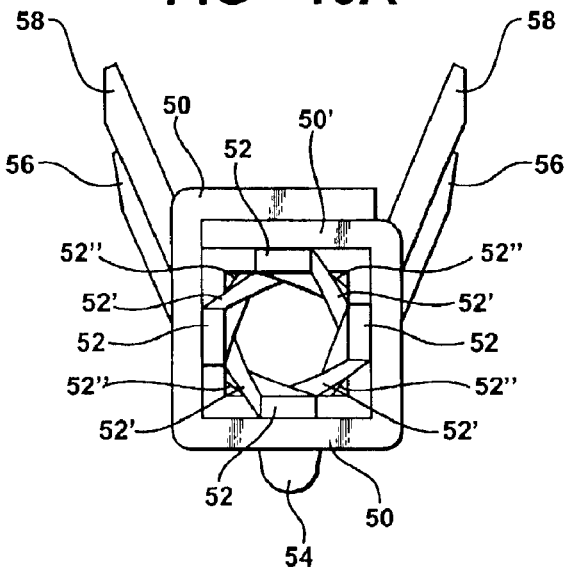
FIG. 10A is an open end view of a square cross sectional and female terminal according to the present invention.

In particular, male terminal 14 having a rectangular (square) cross sectional inserting pin 28 is shown engaged within the open inserting end 62 of the female terminal 10 in FIG. 3 (see also end cutaway view of FIGS. 5A and SC and open end view of FIG. 10A in which both contacting portions 52 of the angled beams are illustrated as well as additional angling and overlapping portions contributing to the helix/hourglass shaped). Whereas the further variant of the male terminal 12 in FIG. 4A, with the round inserting pin 18, is illustrated in alternating fashion inserted into the open end 62 in FIG. 4.

Figure 3A:
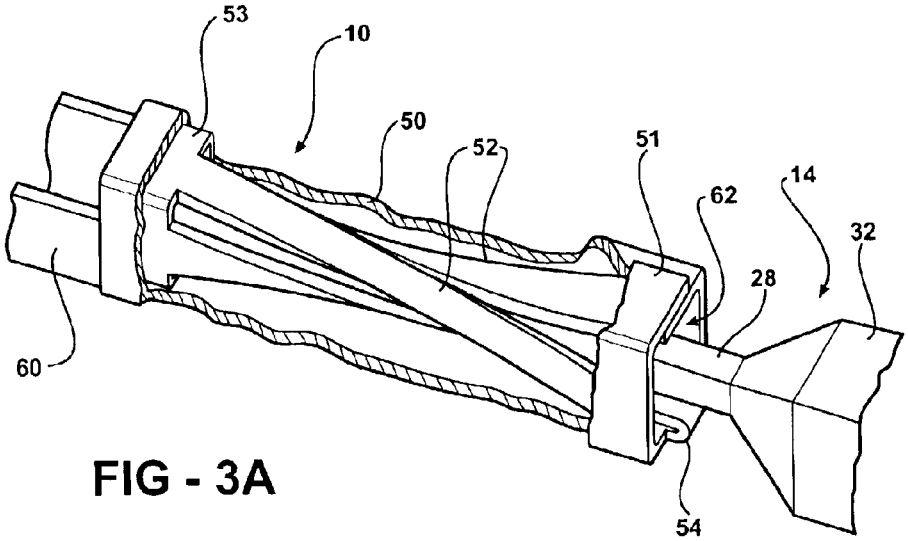
FIG. 3A is a cutaway illustration of the square female terminal illustrated in FIG. 1A, and further showing the combined torsioned and angled contact beams in interengaging fashion with a square cross sectional male inserting pin.

The purpose of the illustrations in FIGS. 3A and 4A is to stress that the design of the integral female terminal 10, and in particular that of the combined angled and torsioned beams 52, is such that a cross sectional configuration of any given male terminal pin (such as again has been previously described by example at 12, 14 or 16) is capable of being inserted into interengaging contact with the female terminal 10.

Figure 3B:
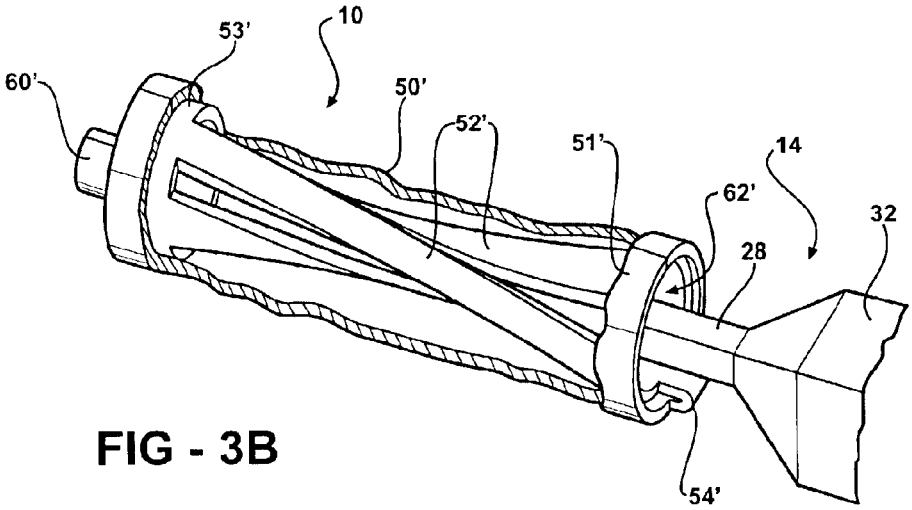
FIG. 3B is a cutaway illustration of the round female terminal illustrated in FIG. 1B, and further showing the combined torsional and angled contact beams in interengaging fashion with a square cross sectional male inserting pin.
Figure 10B:
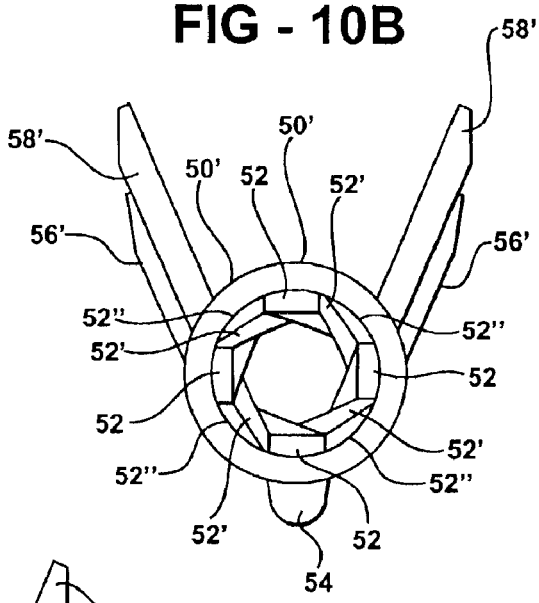
FIG. 10B is an open end view of a round cross sectional and female terminal according to the present invention.

Referring further to the cutaway views of FIGS. 3B and 4B, and the open end view of FIG. 10B, round cross sectional female terminals illustrations are provided and which correspond to those presented at FIGS. 3A and 4A. Accordingly, the same reference numerals are indicated, including angled beams 52', carrier tab portions 51' and 53', and outer body 50'. The round cross sectional male terminal 12, with round inserting pin portion 18, is further illustrated inserted within the open end 62' of the female terminal.

Figure 6A:
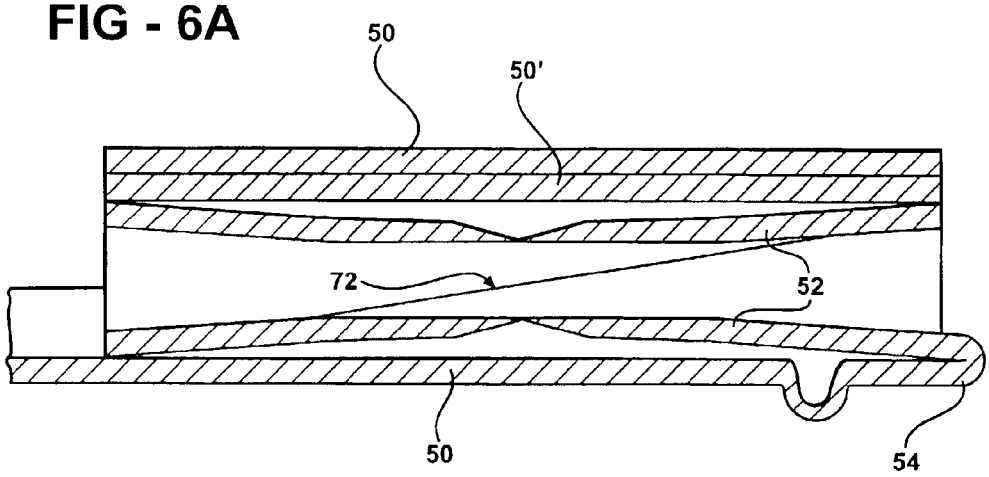
FIG. 6A is an elongated cutaway view of the female terminal illustrated in FIGS. 3A and 4A and showing, in plan cutaway, the combined angling and torsioning of the contact beams.
Figure 6B:
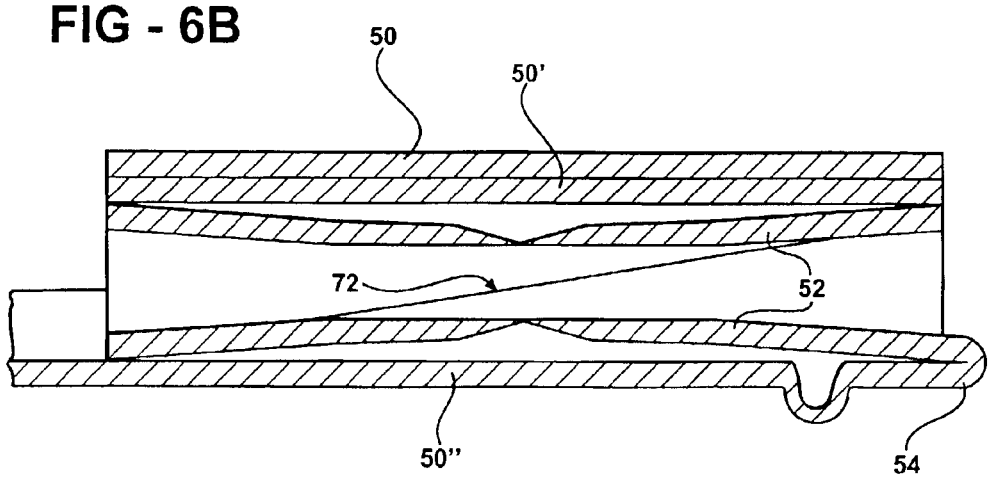
FIG. 6B is an elongated cutaway view of the female terminal illustrated in FIGS. 3B and 4B and showing, in plan cutaway, the combined angling and torsioning of the contact beams.

Referring to FIG. 6B (substantially identical to the previously described illustration of FIG. 6A) in the second preferred embodiment, the rounded and folded portions of the main body 50' of the female terminal main body, which encircle the beams 52', again cause in combination with the mandrels 55' and 57' the combined angling and torsioning of the beams 52' into a substantially helix or hourglass shape (see as again generally represented at 72').

Figure 5B:
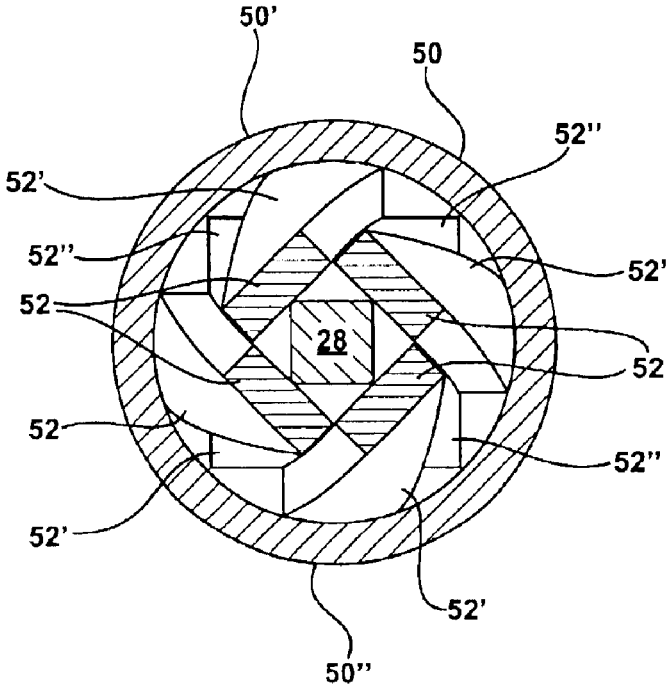
FIG. 5B is an open end view of the female terminal illustrated in FIG. 3B and showing the manner in which the square pin interengages the female terminal.
Figure 5C:
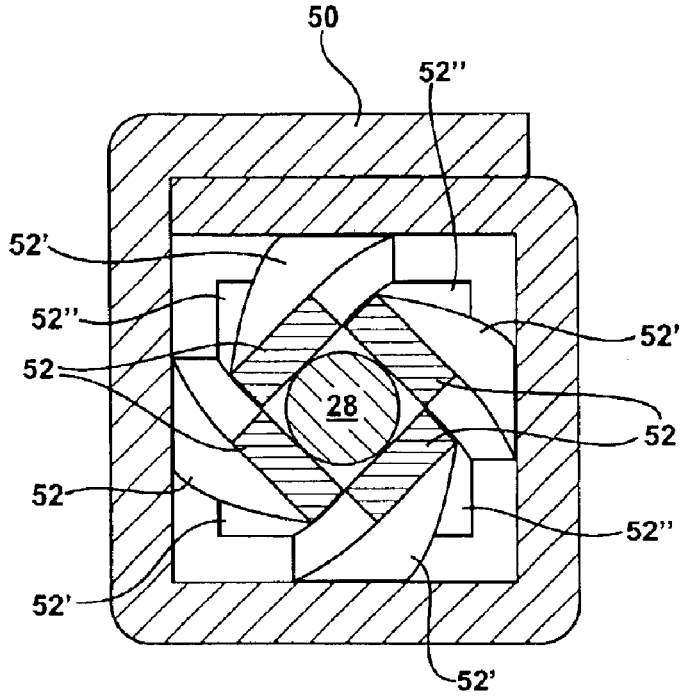
FIG. 5C is an open end view of the female terminal illustrated in FIG. 4A and showing the manner in which the male round pin interengages the female terminal.
Figure 5D:
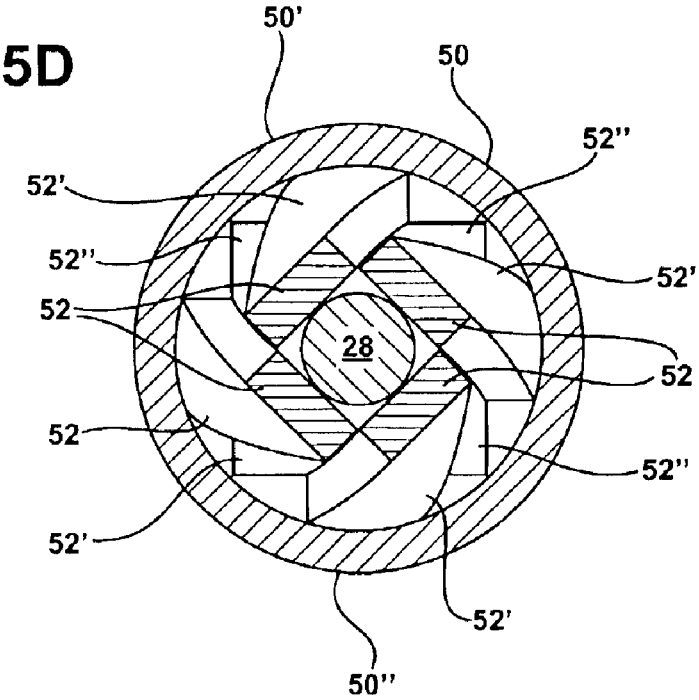
FIG. 5D is an open end view of the female terminal illustrated in FIG. 4B and showing the manner in which the male round pin interengages the female terminal.

Finally, and as is also shown in FIGS. 5B, 5D and 10B (corresponding to FIGS. 5A and 5C for the square cross sectional variant) the open end of the female terminal is illustrated and by which the angled and torsioned beams (corresponding to references 52, 52' and 52" in FIGS. 5A and 5C and repeated herein with the same reference numerals for ease of comparison) are shown in their ultimate configuration about a rectangular pin 28, referring further to FIG. 5B and round pin 28 in FIG. 5D, and in order to maximize the area of contact (see FIGS. 3B and 4B where beam 52' wrapped along male pin and have line contacts) and corresponding normal inserting forces.

Having described the presently preferred embodiments, it is to be understood that the invention may be otherwise embodied within the scope of the appended claims.

What is claimed is:

1. A female terminal for use with an interengaging male terminal exhibiting an extending pin, said female terminal comprising:

an electrically conductive and elongated body having a first interiorly open inserting end revealing therein a plurality of extending, elongated and angled beams integrally formed with said elongated body and engaging the male terminal pin, said beams having opposite ends, said opposite ends of said beams having carrier tab portions separating and supporting said opposite ends of said beams; and said elongated body further including bendable crimping portions at a second end for engaging an associated end of a cable further comprising said plurality of angled and elongated beams, in combination, exhibiting a three dimensional and substantially helical and hourglass shaped configuration.

2. The female terminal as described in claim 1, said elongated body further comprising a rectangular cross sectional configuration within which extend said elongated arid angled beams.

3. The female terminal as described in claim 1, said elongated body further comprising a circular cross sectional configuration within which extend said elongated and angled beams.

4. The female terminal as described in claim 1, further comprising said electrically conductive and elongated body being provided as a metal blank.

5. The female terminal as described in claim 4, said metal blank having a specified shape and size and being constructed of a copper alloy.

6. The female terminal as described in claim 1, said plurality of angled and elongated beams further comprising a combined angled and torsional configuration.

7. The female terminal as described in claim 1, said electrically conductive and elongated body of said female terminal exhibiting a specified shape and size, the interengaging male terminal further including an electrically conductive and elongated body, the pin extending from a first end of the male terminal body, additional and bendable crimping portions extending from a second end of the male body.

8. The female terminal as described in claim 7, said female terminal having a specified shape and size, the male terminal pin further exhibiting a square cross sectional configuration.

9. The female terminal as described in claim 7, said female terminal having a specified shape and size, the male terminal pin further exhibiting a round cross sectional configuration.

10. The female terminal as described in claim 1, further comprising a pair of opposing mandrels engaging front and rear interiorly open inserting ends of said elongated body and in order to avoid spring walk away of said elongated and angled beams.

11. The female terminal as described in claim 10, each of said opposing mandrels exhibiting a specified end face configuration suitable for engaging a corresponding end face configuration of said female open inserting end.

12. The female terminal as described in claim 1, further comprising said angled, elongated and spaced apart beams being folded inwardly along at least one bending line and seated inside said elongated body.

13. The female terminal as described in claim 1, said open inserting end of said female terminal exhibiting a selected shape and size suitable for engaging a male terminal pin having a cross sectional dimension which includes at least one of a 4.3 mm pin, a 2.8 mm pin, a 1.0 mm pin, a 0.6 mm pin, and a 0.45 mm pin.

14. A method for producing a female terminal for use with an interengaging male terminal exhibiting an extending pin, said method for producing comprising the steps of:

providing a substantially flattened and planar shaped blank constructed of a metallic and electrically conductive material, said blank including a planar shaped main body, a plurality of elongated and spaced apart beams extending from a stem portion interconnect to a first end of said main body, said beams having opposite ends, said opposite ends of said beams having carrier tab portions separating and supporting said opposite ends of said beams and wire crimping portions extending from a second end of said main body;

folding said elongated and spaced apart beams inwardly and over said planar shaped main body;

bending said planar shaped main body into a substantially three dimensional and elongate extending shape having an open inserting end and in which is encased said elongated and spaced apart beams; and bending in inward and opposing fashion said wire crimping portions further comprising the step of angling said plurality of beams in a three dimensional array and within an open interior defined by said three dimensionally formed main body;

further comprising the step of torsioning said plurality of beams in combination with said step of angling in order to establish a substantially helical and hourglass shape configuration.

15. The method as described in claim 14, further comprising the step of bending said planar shaped main body into a rectangular cross sectional shape.

16. The method as described in claim 14, further comprising the step of bending said planar shaped main body into a circular cross sectional shape.

* * * * *